US006997799B2

(12) United States Patent
Mrozek et al.

(10) Patent No.: US 6,997,799 B2
(45) Date of Patent: Feb. 14, 2006

(54) DAMPER INCLUDING A STEPPER MOTOR

(75) Inventors: Greg T. Mrozek, Brooklyn Park, MN (US); Scott D. McMillan, Golden Valley, MN (US)

(73) Assignee: Honeywell International Inc., Morristown, NJ (US)

( * ) Notice: Subject to any disclaimer, the term of this patent is extended or adjusted under 35 U.S.C. 154(b) by 87 days.

(21) Appl. No.: 10/632,669

(22) Filed: Aug. 1, 2003

(65) Prior Publication Data

US 2005/0064811 A1 Mar. 24, 2005

(51) Int. Cl.
*F24F 11/00* (2006.01)

(52) U.S. Cl. ..... 454/325; 251/129.11; 318/696

(58) Field of Classification Search ..... 454/297, 454/335, 299, 300, 303, 325; 700/277; 318/696; 251/129.11

See application file for complete search history.

(56) References Cited

U.S. PATENT DOCUMENTS 4,931,948 A * 6/1990 Parker et al. ..... 700/277
5,006,772 A * 4/1991 Danby ..... 318/696
5,033,433 A * 7/1991 Churchill et al. ..... 123/361
6,692,349 B1 * 2/2004 Brinkerhoff et al. ..... 454/256
2001/0055947 A1 * 12/2001 McCabe ..... 454/369
2003/0213852 A1 11/2003 Demster
2003/0213853 A1 11/2003 Demster
2004/0007001 A1 1/2004 Demster
2004/0007627 A1 1/2004 Demster

FOREIGN PATENT DOCUMENTS

JP 09222033 A * 8/1997
JP 0200029766 A * 10/2000

OTHER PUBLICATIONS

"Small Precision Motors—PM42L–048," *Minebea Electronics Co., Ltd.*, 1 pg. (©2001–2002).

* cited by examiner

*Primary Examiner*—Harold Joyce
(74) *Attorney, Agent, or Firm*—Gregory Ansems

(57) ABSTRACT

A damper unit for an air circulation system. The damper unit includes a frame defining an air flow opening, a damper vane for opening and closing the air flow opening, and a stepper motor for turning the damper vane between the open and closed positions. The stepper motor is directly coupled to the damper vane to move the vane between the open and closed positions. A shaft of the stepper motor extends through a frame of the damper unit and is coupled to the damper vane by a hub. A controller is coupled to the stepper motor to control the stepper motor.

2 Claims, 15 Drawing Sheets

DAMPER INCLUDING A STEPPER MOTOR

TECHNICAL FIELD

The present invention generally relates to heating, ventilating, and air-conditioning systems. In addition, the present invention relates to damper devices and motors for driving damper devices and controlling air flow in an air circulation system.

BACKGROUND

Heating, ventilating, and air-conditioning (HVAC) systems are commonly used to condition the air inside commercial and residential buildings. A typical HVAC system includes a furnace to supply heated air and an air-conditioner to supply cooled air to the building.

A system of ducts is typically used to route the heated or cooled air from the furnace or air-conditioner to various points within the building. For example, supply ducts can be run from an air-conditioner to one or more rooms in a building to provide cooled air to the rooms. In larger buildings, the ducts typically terminate in the space above a false ceiling, and a diffuser assembly is positioned within the false ceiling to deliver the conditioned air from the duct into the room of the structure. In addition, return ducts can be used to return air from the rooms to the air-conditioner or furnace for cooling or heating.

Damper assemblies are commonly used to control air flow through HVAC ducts. For example, a damper assembly can be used to restrict air flowing through a duct until the HVAC system determines that conditioned air needs to be provided to a room within the structure. The HVAC system can then, for example, turn on the air-conditioner blower and open the damper assembly to allow air to be forced through the duct and diffuser assembly into the room.

In large structures such as office buildings, the building can be divided into a series of zones so that conditioned air is only provided to a specific zone as needed. For example, each zone can include its own series of ducts, and damper assemblies can be positioned at a source of each series of ducts to open and close as necessary to deliver conditioned air to one or more of the ducts. In this manner, separate zones can be conditioned separately as desired.

While existing HVAC systems effectively provide conditioned air throughout a structure, such systems can be expensive to build and maintain. For example, initially duct work must be run from the HVAC system source (e.g., furnace or air-conditioner) to each separate point at which conditioned air is to be provided. Further, depending on how each "zone" within a structure is configured, it may be difficult to provide desired conditioning to a specific area of a building. For example, if the zones are too large in size, it may be difficult to provide the correct mixture of conditioned air for a given zone. In addition, if the rooms within a building are reconfigured after the HVAC system has been installed, it may be necessary to reroute existing duct work to provide a desired level of conditioning for the new configuration of rooms.

To overcome the problems associated with conventional HVAC systems, a so-called "duct-less" HVAC system has been developed. FIG. 1 schematically shows an example of this type of system 100. The system 100 includes an air supply plenum 120, an air return plenum 130, and a conventional air conditioning unit 110. The air supply plenum 120 is positioned above a floor space 159 desired to be cooled, and is separated from the floor space 159 by a barrier such as a suspended ceiling 172. The air return plenum 130 is positioned above the air supply plenum 120 and is separated from the air supply plenum 120 by a barrier layer 174. Air return conduits 125 pass through the air supply plenum 120 to provide fluid communication between the conditioned floor space 159 and the return plenum 130. The air conditioner 110 provides conditioned air to the air supply plenum 120 via air supply conduits 115 that pass through the return plenum 130.

The air supply plenum 120 is adapted to provide conditioned air to multiple zones 160A, 160B of the floor space 159. A separate damper or dampers 150A, 150B are provided for each of the different zones 160A, 160B. Zone 160A is cooled by opening damper 150A such that cool air flows from the air supply plenum 120 into the zone 160A. Similarly, to cool the zone 160B, the damper 150B is opened thereby allowing cool air from the air supply plenum 120 to flow into the zone 160B.

While the floor space 159 is shown divided into two regions 160A, 160B, it will be appreciated that in normal applications the given floor space may have a much larger number of zones. For example, in a given floor space of a building, each room of the building may be designated as a different zone thereby allowing the temperature of each room to be independently controlled. Also, while FIG. 1 shows a single floor space, in multi-floor buildings, the return and supply plenums can be positioned between the floors of the building.

In the system of FIG. 1, the air temperature and air pressure within the air supply plenum 120 are maintained at selected constant values. The supply plenum 120 preferably overlies the entire floor space of the building, and provides conditioned air to all of the zones of the floor space. Therefore, separate lines of ductwork are not required to be installed for each zone. This reduction in ductwork assists in reducing original construction costs and also reduces costs associated with reconfiguring a given floor plan.

SUMMARY

One inventive aspect of he present disclosure relates to damper devices adapted for use with air-plenum type air handling systems.

Another inventive aspect of the present disclosure relates to a stepper motor that can be directly coupled to a damper vane to move the vane between open and closed positions.

A further inventive aspect of the present disclosure relates to a stepper motor that can be coupled to a damper vane without use of additional structure such as a gear train positioned between the stepper motor and the vane.

Examples of a variety of inventive aspects in addition to those described above are set forth in the description that follows. It is to be understood that both the foregoing general description and the following detailed description are exemplary and explanatory only and are not restrictive of the broad inventive aspects that underlie the examples disclosed herein.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternative forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Figure 1:
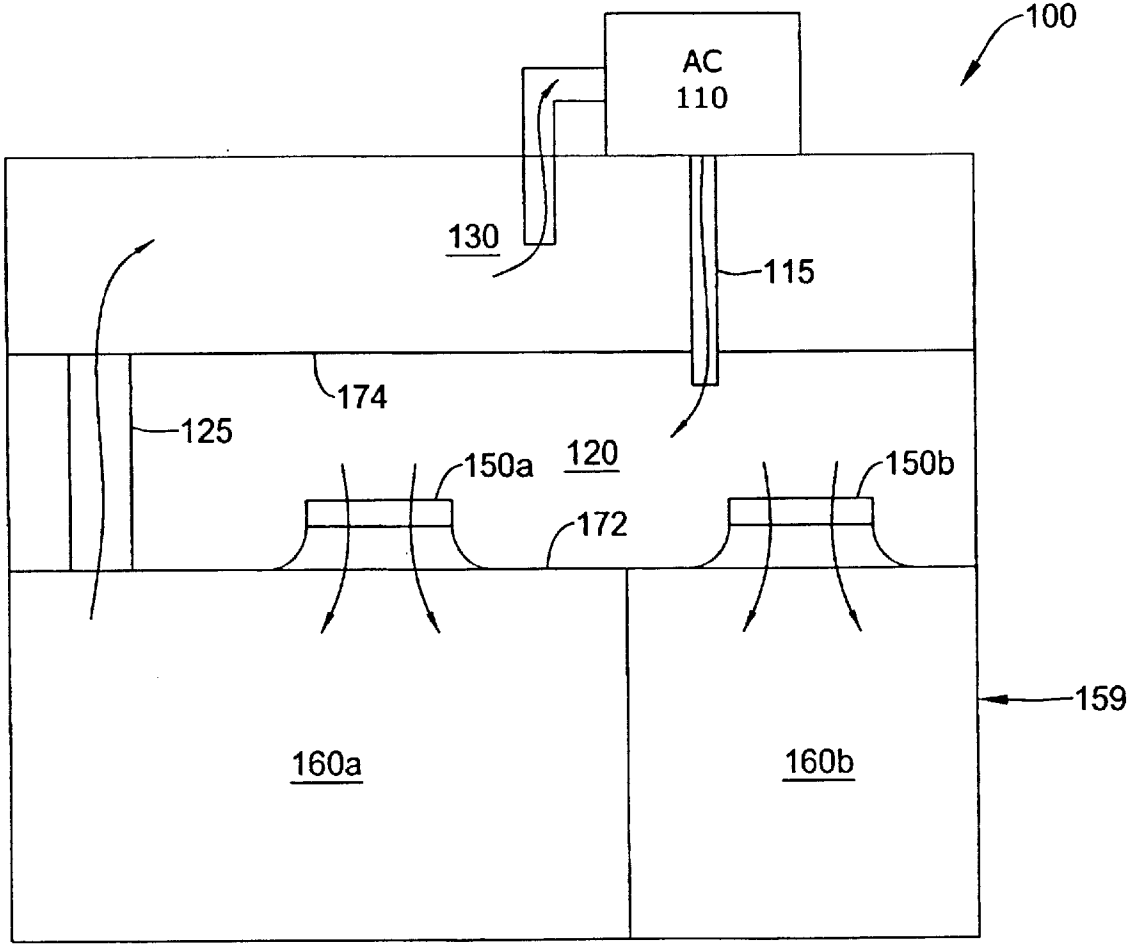
Figure 1 (Prior Art)
FIG. 1 schematically illustrates a prior art air circulation/conditioning system.

In air handling/circulation systems such as the system 100 of FIG. 1, the dampers 150A, 150B are positioned in close proximity to the underlying floor space 159. Therefore, it is desirable to minimize damper noise that may be distracting to occupants of the underlying space. It is also desirable to minimize the power consumption and size of the motors used to drive the vanes of the dampers. Some aspects of the present disclosure relate to features for overcoming problems associated with air-plenum type air circulation systems. In certain embodiments, dampers in accordance with the principles of the present disclosure can be used in an air plenum system having an air supply plenum maintained at a constant temperature in the range of 50 to 60 degrees Fahrenheit, and a constant pressure maintained in the range of 0.025 to 0.1 inches of water. In other embodiments, the pressure in the air supply plenum can be maintained in the range of 0.04 to 0.075 inches of water, or at a pressure of about 0.05 inches of water.

However, it will be appreciated that the various inventive aspects disclosed herein are not limited to the air-plenum field. Quite to the contrary, the various inventive aspects disclosed herein are applicable to any type of air handling system regardless of whether the system utilizes air plenums, ducts or other air conveying means. Further, although the example air handling system described herein includes air plenums formed above a floor space, the air plenums can also be placed below a floor space if desired.

Certain inventive aspects of the present disclosure relate to a stepper motor that is coupled to a damper vane to drive the vane between open and closed positions. In example embodiments disclosed herein, the term "stepper motor" is generally used to reference a motor including stationary windings and poles formed on a rotor, and a shaft that can be made to rotate in discrete steps by alternating the polarity of voltage applied across the windings in the correct sequence.

In one embodiment, the stepper motor is directly coupled to the damper vane to drive the vane. For example, the shaft of the stepper motor can be coupled to the damper vane without requiring an intermediate gear train, thereby reducing noise and wear associated with the use of a gear train. Further, use of the stepper motor to drive the damper vane can reduce power consumption and increase control as the vane is moved between open and closed positions. In addition, use of a stepper motor allows the vane to be driven open and closed at relatively higher speeds than prior art systems.

Figure 2:
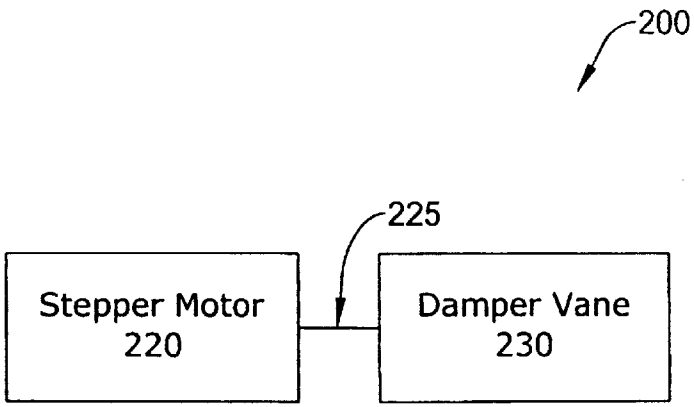
FIG. 2 schematically illustrates an example damper device having features that are examples of how inventive aspects in accordance with the principles of the present disclosure may be practiced.

Referring now to FIG. 2, a schematic drawing illustrating an example damper device 200 including a stepper motor 220 and damper vane 230 is shown. The stepper motor 220 is preferably directly coupled to the damper vane 230 to move the vane, for example, between open and closed positions.

The term "directly coupled" is used herein to mean that no intermediate gears are provided between a shaft (shown schematically as 225 in FIG. 2) of the stepper motor 220 and the vane 230 so that the vane 230 and the shaft 225 rotate at substantially the same rate of rotation. The term "directly coupled" does include coupling techniques where one or more intermediate pieces are used to fix the shaft 225 relative to the damper vane 230 (see, for example, hub 450 shown in FIG. 12A).

In a preferred, non-limiting embodiment, the stepper motor is a 1 watt electric motor that can generate 3.5 inch ounces of torque. Preferably, the stepper motor includes a 42 mm can, and at least 12 steps per revolution, more preferably at least 24 steps, and even more preferably at least 48 steps per revolution. Example stepper motors are sold by Minebea Electronics Company of Japan.

In the example shown, at least two motor positions are selected so that the motor can be used to move the damper vane 220 from a first position to a second position. In a preferred embodiment, the first position is a closed position for the vane 220, while the second position is an open position for the vane 220.

It can be advantageous to use a stepper motor to move the damper vane for several reasons. For example, use of a stepper motor may reduce or eliminate the need for a gear train, thereby reducing noise associated with the gear train, cost of manufacture, and failure due to wear of the gear train parts. Further, movement of the stepper motor can be controlled so that the vanes of the damper are accurately positioned as desired. In addition, the rotational speed of the stepper motor can be controlled to allow for precise movement of the vanes.

Figure 3:
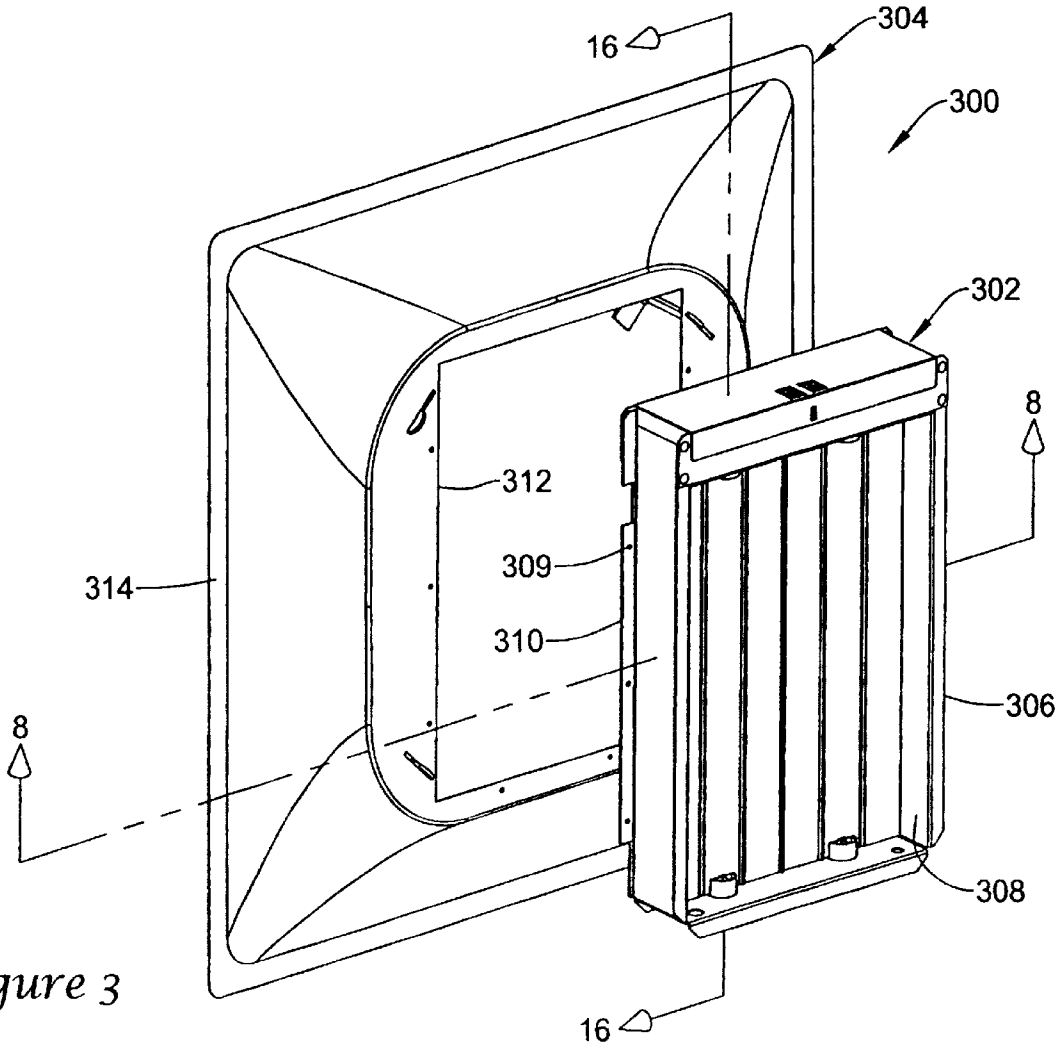
FIG. 3 is a perspective view of another air-handling device having features that are examples of how inventive aspects in accordance with the principles of the present disclosure may be practiced.

FIG. 3 illustrates an air handling device 300 having features that are examples of inventive aspects in accordance with the principles of the present disclosure. The air-handling device 300 includes a damper unit 302 and an air diffuser 304. The damper unit 302 includes a frame 306 defining an airflow opening 308. The frame 306 of the damper unit 302 can be connected to the air diffuser 304 by conventional techniques such as fasteners (e.g., screws, bolts, clips or rivets), welding or a snap-fit connection. As shown in FIG. 3, frame 306 is connected to the air diffuser 304 by fasteners that extend through openings 309 defined by flanges 310 of the frame 306. When the damper unit 302 is secured to the diffuser 304, the airflow opening 308 of the frame 306 aligns with a corresponding opening 312 defined by the air diffuser 304.

Figure 4:
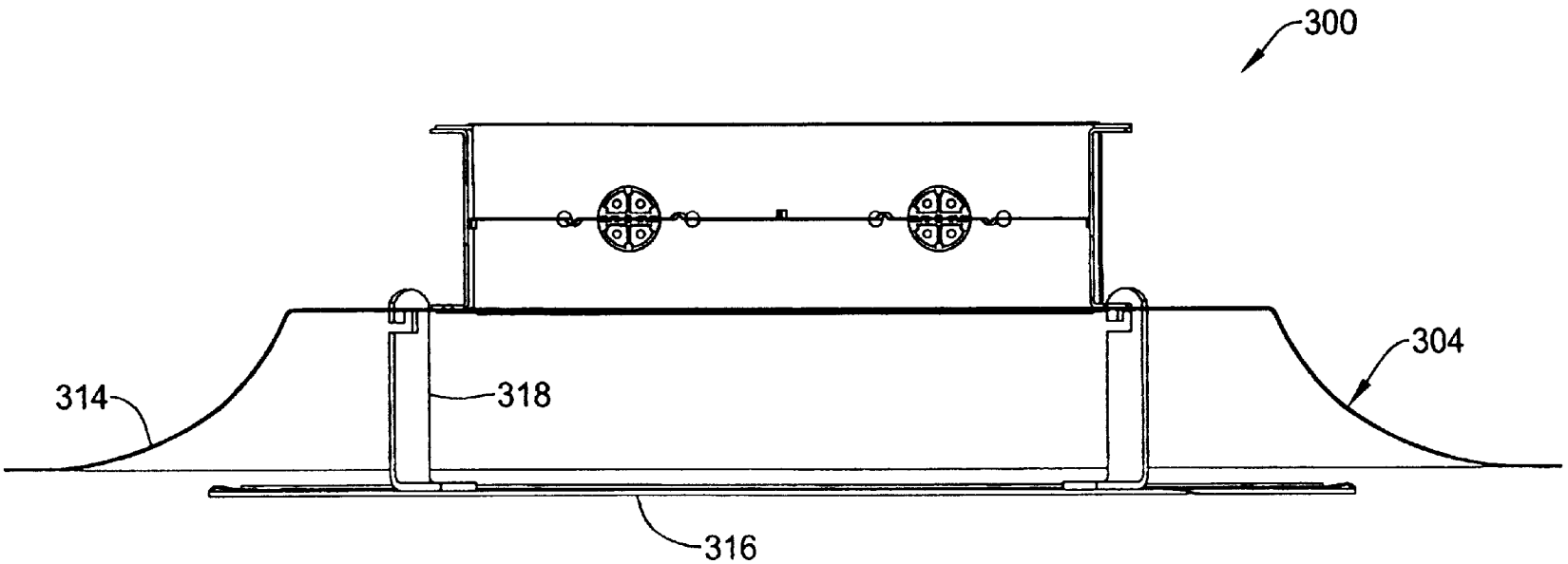
FIG. 4 is a cross-sectional view taken along section line 8—8 of FIG. 3.
Figure 6:
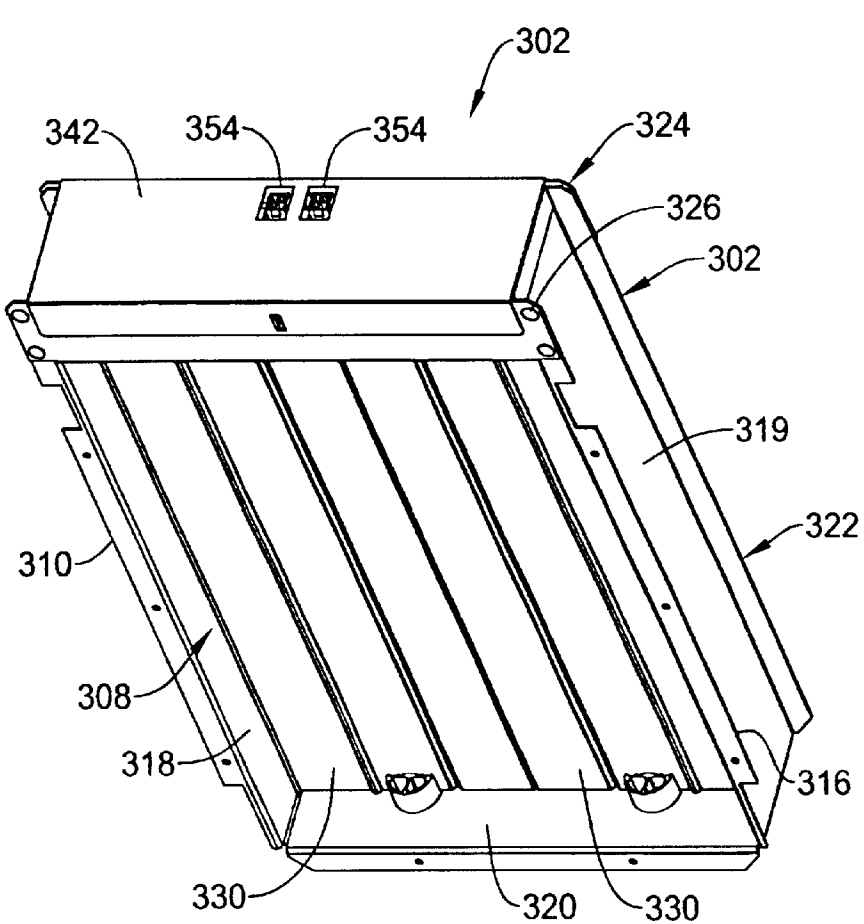
FIG. 6 is another perspective view of the damper unit of FIG. 5.
Figure 5:
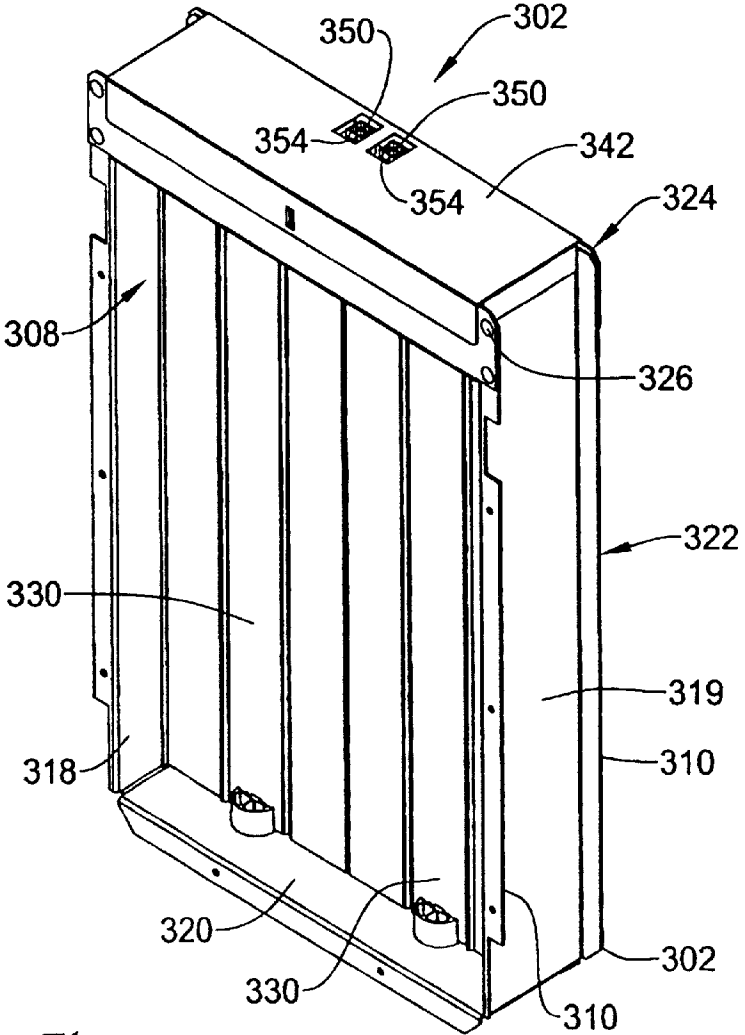
FIG. 5 is a perspective view of a damper unit that is part of the air-handling device of FIG. 3.
Figure 8:
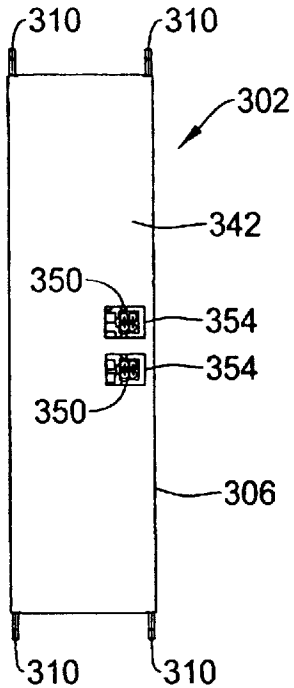
FIG. 8 is a right end view of the damper unit of FIG. 7.
Figure 7:
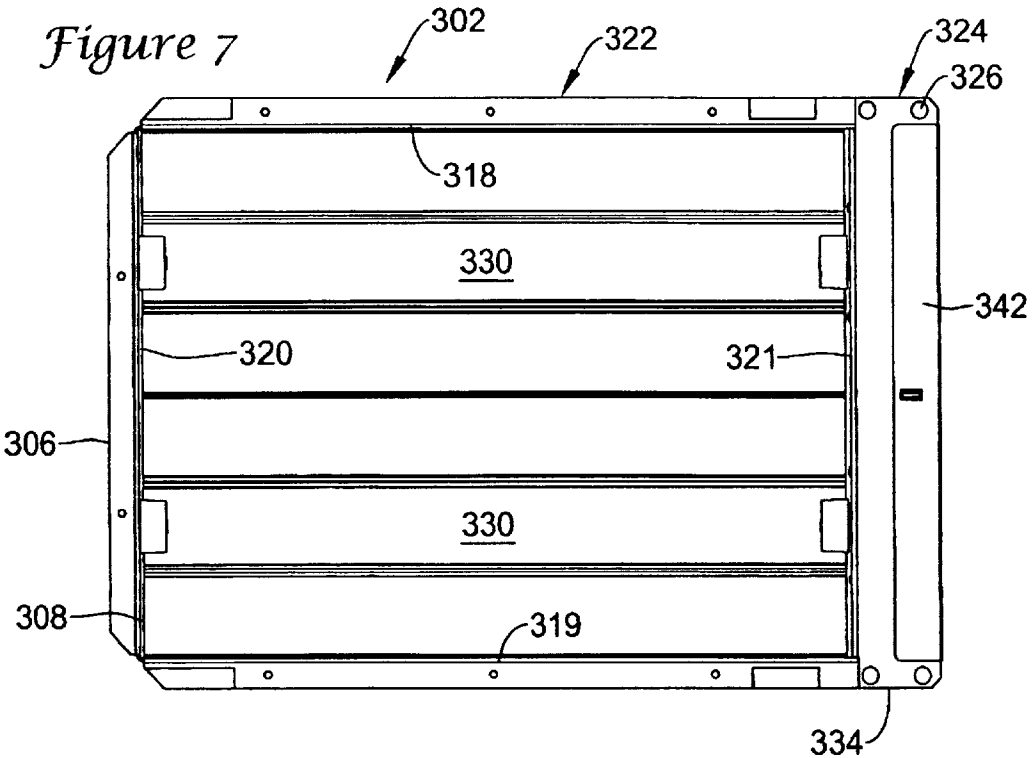
FIG. 7 is a top plan view of the damper unit of FIG. 5.
Figure 9:
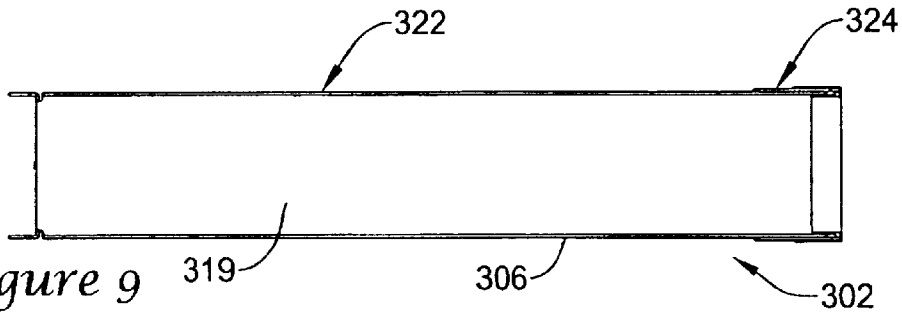
FIG. 9 is a front, elevational view of the damper unit of FIG. 7.

As best shown in FIG. 4, the air diffuser 304 includes an outer skirt 314 that tapers outwardly from the opening 312. The air diffuser 304 also includes an inner diffuser structure 316 connected to the outer skirt 314 by hooks 318. In use, the damper unit 302 functions selectively open and close air flow to the air diffuser 304, and the air diffuser functions to diffuse or spread airflow provided to the diffuser through the damper unit 302.

Referring now to FIGS. 5–10, the damper unit 302 is shown in isolation from the air diffuser 304. The frame 306 of the damper unit 302 has a generally rectangular configuration including two opposing major side walls 318, 319 interconnected by two opposing, minor side walls 320, 321. Inner surfaces of the side walls 318–321 define the airflow opening 308 of the damper unit 302.

It will be appreciated that the side walls 318–321 can be manufactured from any number of different types of materials such as metal, plastic or other materials. In the depicted embodiment, side walls 318, 319 and 320 are defined by a first component 322 (e.g., a first piece of bent sheet metal), and the side wall 321 is defined by a second component 324 (e.g., a second piece of bent sheet metal). The second component 322 is fastened to the major side walls 318,319 by fastening structures such as rivets 326. To increase the rigidity of the frame 306, flanges 310 are provided about the outer perimeter of the frame 306.

Figure 12:
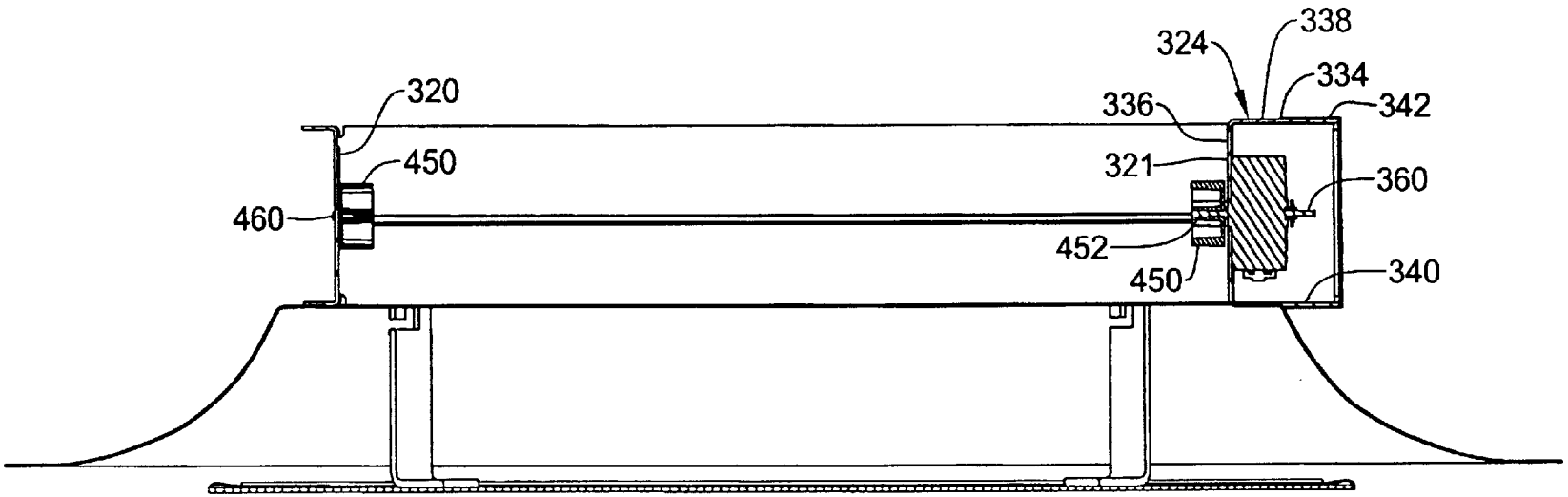
FIG. 12 is a cross-sectional view taken along section line 16—16 of FIG. 3.

The damper unit 302 is equipped with two damper vanes 330 for selectively opening and closing the airflow opening 308. The damper vanes 330 are rotated relative to the frame 306 between open and closed positions by drive motors 332 (see FIG. 10). The drive motors 332 are positioned within a housing 334 located at one end of the frame 306. The housing 334 is defined primarily by the second component 324. For example, as shown in FIG. 12., the component 324 defines an upright wall 336 corresponding to the minor side wall 321 of the frame 306. The second component 324 also includes a top wall 338 and a bottom wall 340. The housing 334 further includes a removable cover 342 that fastens to the top and bottom walls 338, 340 at a location opposite from the upright wall 336. Portions of the major side walls 318, 319 of the flame 306 extend past the upright wall 336 to enclose opposite ends of the housing 334.

Figure 10:
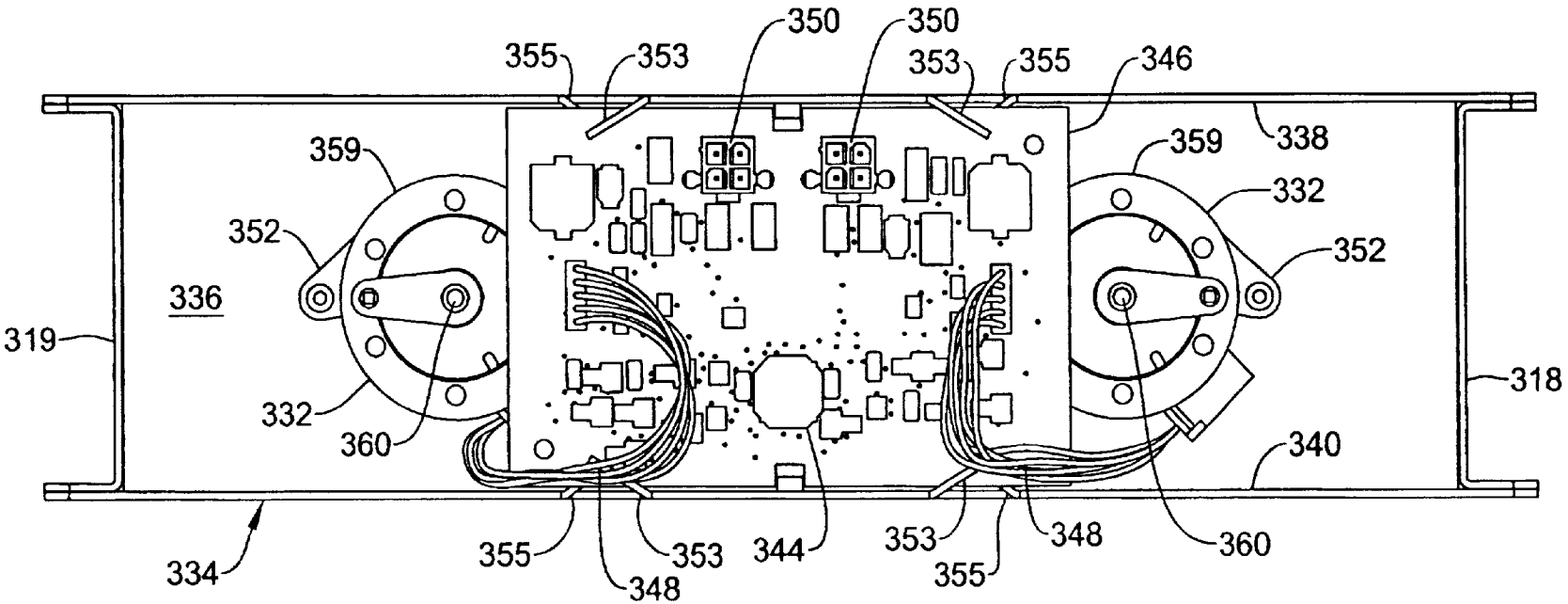
FIG. 10 is a right end view of the damper unit of FIG. 9 with an end cover removed to show an interior of a motor housing.

Referring to FIG. 10, two drive motors 332 are positioned within the housing 334. The motors 332 are controlled by a control device including a microcontroller 344 mounted on a printed circuit board 346. Wires 348 electrically connect the control device to the motors 332. The control device is also equipped with input/output ports 350 mounted on the circuit board 346. The cover 342 can include openings 354 (see FIGS. 5 and 6) for providing ready access to the input/output ports 350 even when the cover is secured to the top and bottom walls 338, 340 of the housing 334. As described in U.S. application Ser. No. 10,632,672, entitled "Bi-Directional Connections for Daisy-Chained Dampers" and filed on a date concurrent herewith, the ports 350 can be used to coupled the control device to a main controller, and/or to daisy chain multiple damper units together. The above-identified application is hereby incorporated by reference in its entirety.

Figure 11:
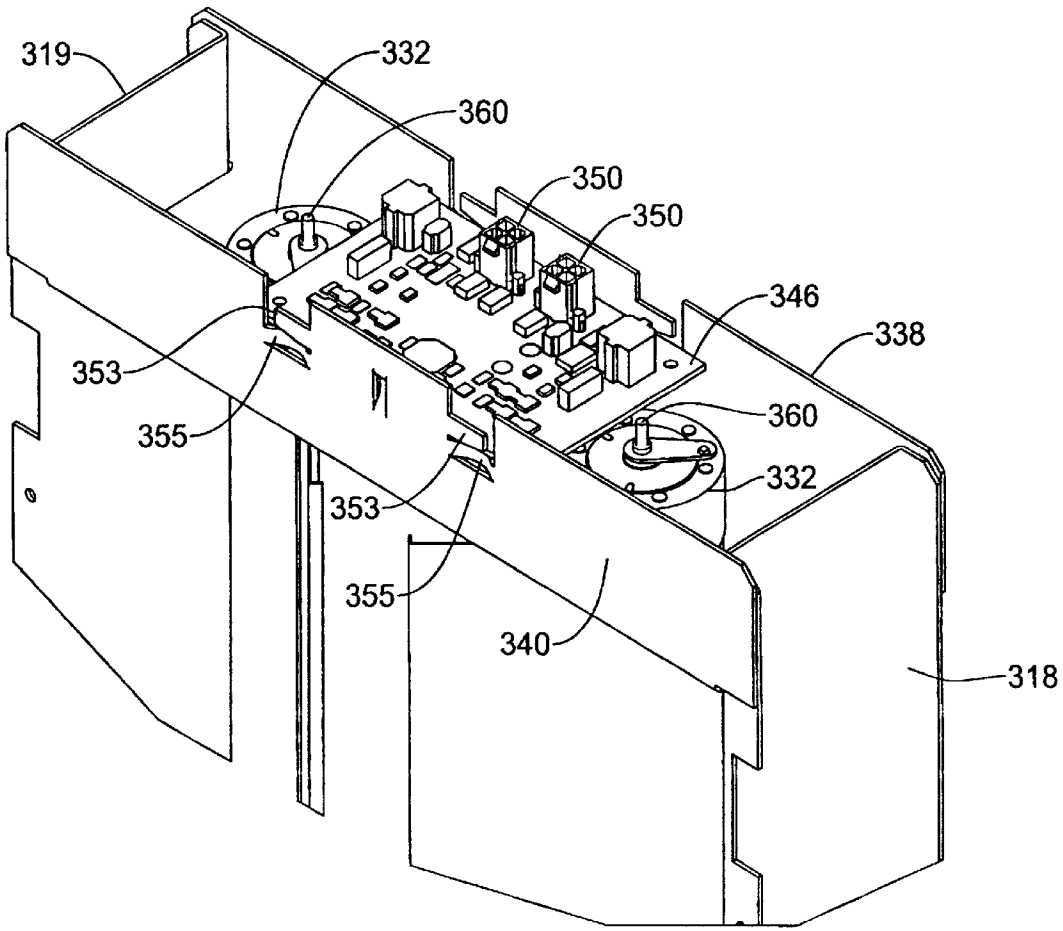
FIG. 11 is a perspective view of the motor housing of FIG. 10.

Still referring to FIG. 10, the drive motors 332 are preferably mounted to the upright wall 336. For example, the motors 334 can include casings 359 having mounting flanges 352 for securing the motors 332 directly to the upright wall 336 by conventional fasteners such as rivets, clips, screws, bolts or other fastening techniques. The printed circuit board 346 and wires 348 are preferably mounted within the housing 334. The top and bottom walls 338, 340 of the housing 334 can include sets of inwardly bent tabs 353, 355 (see FIG. 11) for mounting and securing the circuit board 346 within the housing 334. Edges of the circuit board 346 are adapted to be captured between the sets of tabs 354, 355.

While the drive motors 332 can be any type of drive mechanism, as noted above preferred drive mechanisms for rotating the vanes 330 include stepper motors. The drive motors 332 are shown including drive shafts 360 driven by drive mechanisms housed within the casings 359 of the motor 332.

In preferred embodiments, the stepper motors are used to modulate the amount of time that the damper vanes are open for each duty cycle. It is therefore preferably to configure the motor to open and close the vanes in a short amount of time. In one example, each vane can be opened or closed in less than 10 seconds, more preferably less than 5 seconds, and even more preferably less than 2 seconds. In one embodiment the motors 332 are configured to open or close each vane in about 1 second.

Figure 12A:
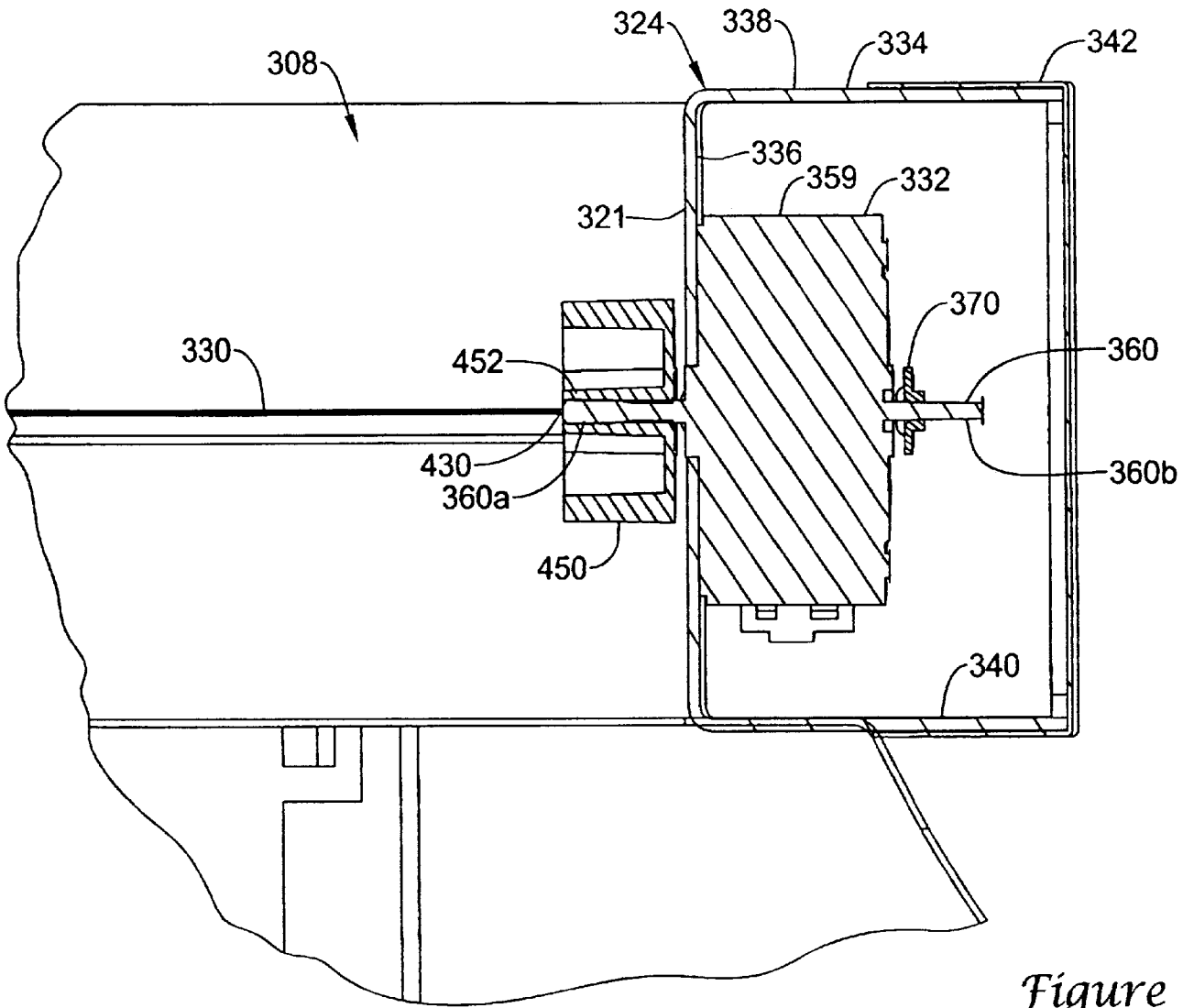
FIG. 12A is an enlarged, detailed view of a portion of FIG. 12.

Referring to FIGS. 12 and 12A, a cross-sectional view through one of the motors 332 is provided. As is apparent from FIG. 12, the motor 332 is mounted directly to the upright wall 336. As indicated previously, the upright wall 336 corresponds to the minor side wall 321 having an Inner surface that defines one of the sides of the airflow opening 308. The drive shaft 360 of the motor 332 includes a first end 360A that extends through the upright wall 336 and projects into the airflow opening 308. For example, the first end 360*a* is shown projecting through an opening 362 in the upright wall 336 so as to extend into the airflow opening 308. The first end 360*a* of the shaft 360 is preferably directly coupled to one of the damper vanes 330.

Figure 19:
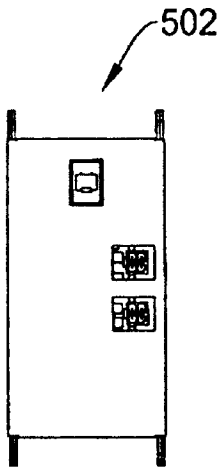
FIG. 19 is a right end view of the damper unit of FIG. 18.
Figure 21:
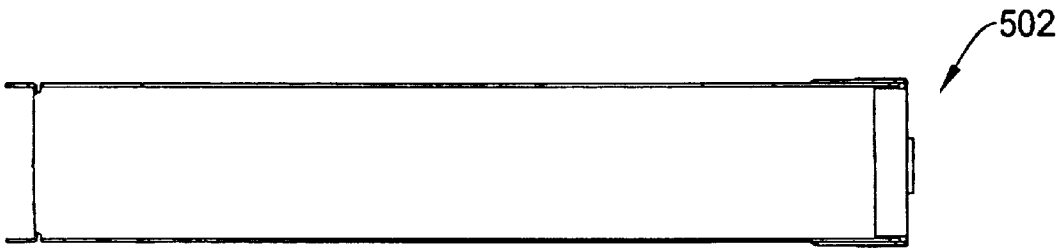
FIG. 21 is a front elevational view of the damper unit of FIG. 18.
Figure 20:
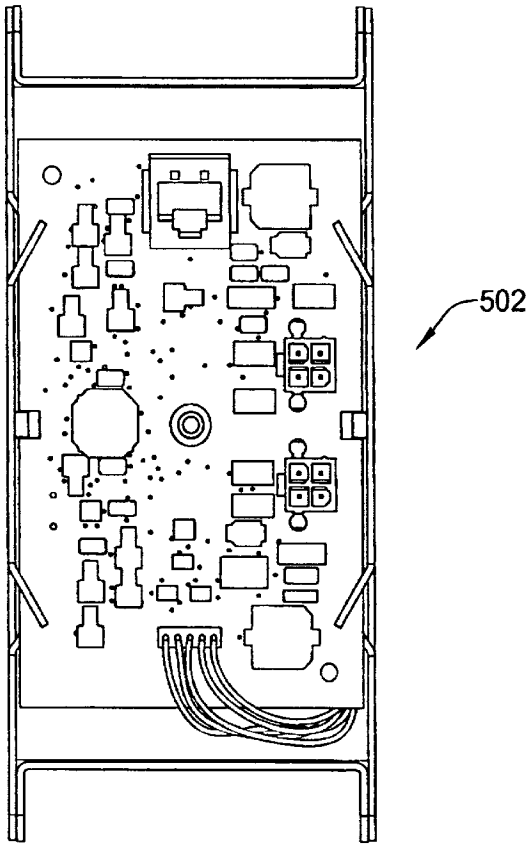
FIG. 20 is a right end view of the damper unit of FIG. 18 with an end cover removed to show the interior of a motor housing.

Referring to FIGS. 19–21, one of the damper vanes 330 is shown in isolation from the remainder of the damper unit. The depicted damper vane 330 has a generally rectangular shape having oppositely positioned major edges 410, 411 and oppositely positioned minor edges 412, 413. Similar to the vane embodiments described above, the vane 330 includes aerodynamic features for using air flow to generate supplemental torque for rotating the vane. For example, a first lip 415 is shown positioned at the major edge 410, and a second lip 416 is shown positioned at the major edge 411. The lips 415, 416 are shown having lengths that are generally parallel to an axis of rotation 418 of the vane 330. As depicted and FIGS. 19–21, the lips 415, 416 extend along the entire lengths of the major edges 410, 411. However, in alternative embodiments, the lips 415, 416 may extend along only portions of the edges 410, 411, or be arranged in other configurations.

Figure 17:
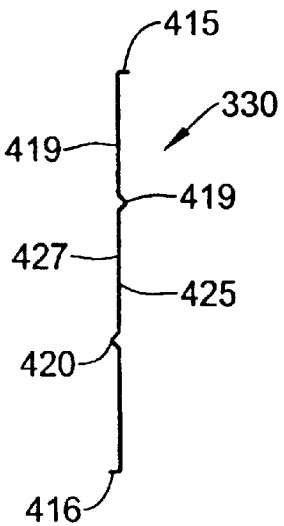
FIG. 17 is a right end view of the damper vane of FIG. 16.

As best shown in FIG. 17, the lips 415, 416 project outwardly from opposite major sides 425, 427 (i.e., major faces) of a main body 409 of the vane 330. The vane 330 also includes integral ribs 419, 420 for reinforcing the main body 409. Rib 419 is positioned between the first lip 415 and the axis of rotation 418 of the vane 330, and projects outwardly from the first major side 425 of the main body 409. Rib 420 is positioned between the second lip 416 and the axis of rotation 418, and projects outwardly from the second major side 427 of the main body 409. As depicted in FIG. 17, the ribs 419, 420 comprise bends (e.g., 90 degree bends) provided in the main body 409.

Figure 16:
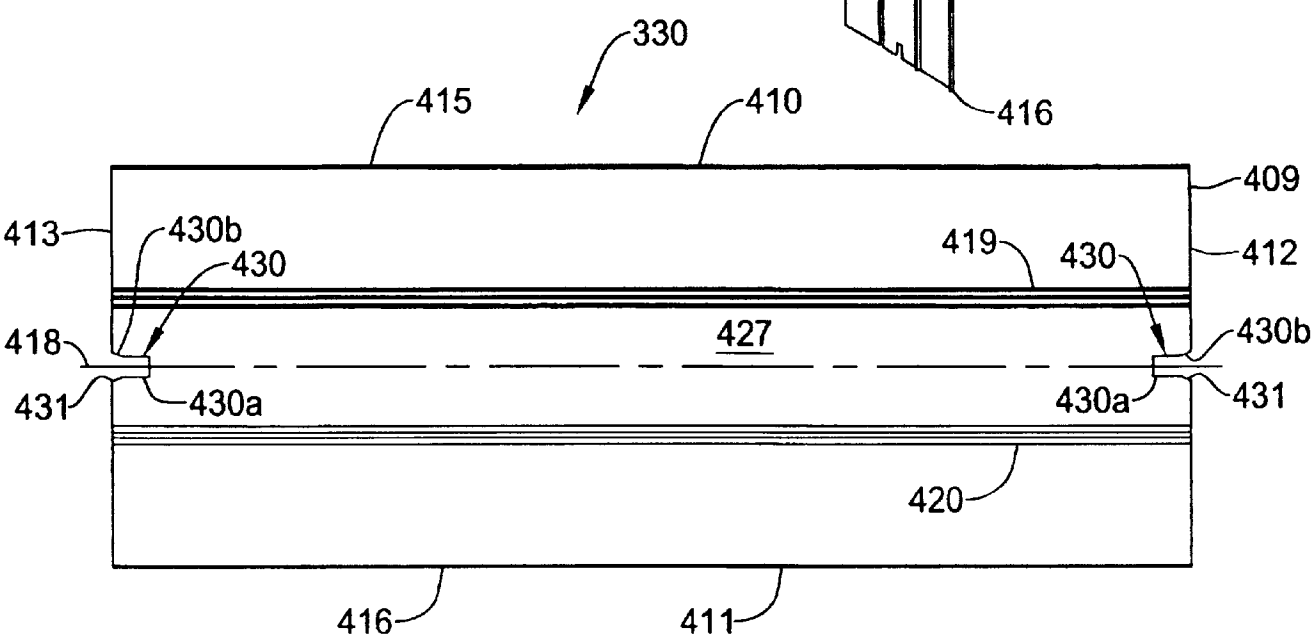
FIG. 16 is a plan view of the damper vane of FIG. 15.

Referring to FIG. 16, notches 430 are provided at the minor edges 412, 413 of the vanes 330. The notches 430 are positioned at the axes of rotation 418 of the vanes 330 and are provided to facilitate coupling the vanes 330 to drive mechanisms. Each of the notches 430 includes a generally rectangular portion 430*a* and tapered portion 430*b*. The notches 430 are defined by notch edges 431.

It is preferred for the drive mechanism rotating the vanes 330 to rotate one of the vanes only in the clockwise direction. Thus, the vane is rotated in the clockwise direction when moved from the closed position to the open position, and when the vane is moved from the open position back to the closed position. Thus, the inner and outer ends of the vane are constantly alternating. It will be appreciated that the other vane 330 operates in a similar manner. For example, the drive mechanism drives the other vane in the counter-clockwise direction when moving the vane from the closed position to the open position, and when moving the vane from the open position to the closed position.

In a preferred embodiment, the vanes 330 are further configured as described in U.S. application Ser. No. 10/632,513, entitled "Damper Vane" and filed on a date concurrent herewith. The above-identified application is hereby incorporated by reference in its entirety.

Referring to FIGS. 16, 16A and 17, hubs 450 are used to provide direct connections between the first ends 460*a* of the shafts 460 and the minor edges 412 of the damper vanes 330. The hubs 450 are preferably made of a plastic material, but could also be made of other materials. The hubs 450 include center sleeves 452 in which the first ends 460A of the shafts 460 are fixedly mounted such that the hubs 450 and the shafts 460 are not free to rotate relative to one another. For example, the first ends 460*a* of the shafts 460 can be pressed within the sleeves 452 with splines of the shafts imbedded within the sleeves 452 to prevent relative rotation therein-between.

Figure 13:
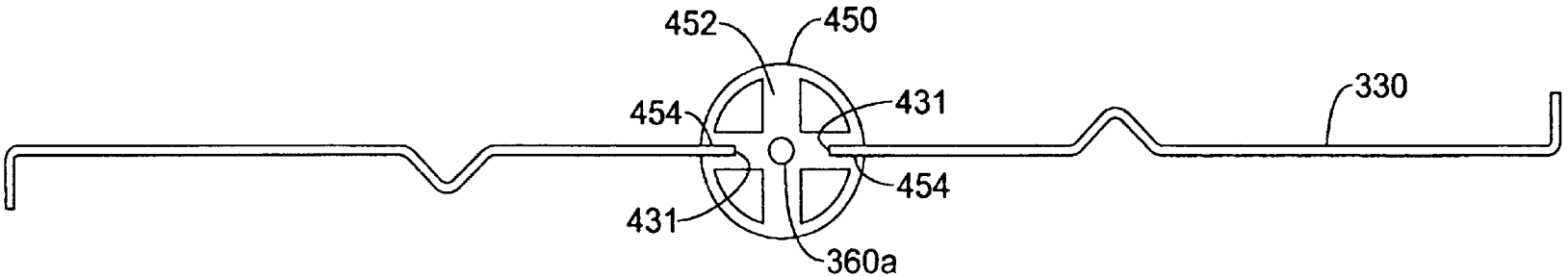
FIG. 13 is a cross-sectional view through one of the damper vanes of the damper unit of FIG. 5.

Referring still to FIG. 12A, the sleeves 452 of the hubs 450 fit within the notches 430 of the vane 330. Also, as shown in FIG. 13, the notch edges 431 fit within slots 454 defined by the hubs 450 to provide a connection between the hub 450 and the vane 330.

Hubs 450 are also used to connect the minor edges 413 of each of the vanes 330 to the frame 306. For example, as shown in FIG. 12, the minor edges 413 of the vanes 330 can be rotatably coupled to the minor side wall 320 of the frame 306 by hubs 450 mounted on pins 460. The pins 460 are preferably pressed through openings in the minor side wall 320. The pins 460 are preferably mounted so as to not rotate relative to the minor side wall 320. The pins 460 fit within the sleeves 452 of the hub 450. The pins 460 are preferably smaller than the openings in the sleeve 452 such that the hubs 450 are capable of rotating freely relative to the pins 460. The hubs 450 engage the minor edges 413 of the vanes 330 in the same manner described above with respect to the minor edges 412 of the vanes 330.

To assembly the damper unit 302, the motors 332 are first fastened to the upright wall 336 and the shafts 460 are mounted to the minor side wall 320 of the frame 306. The hubs 450 are then mounted on the pins 460 and on the first ends 360A of the drive shaft 360. Next, prior to connecting the first and second components 322, 324 of the frame 306 together, the vanes 330 are mounted in the hubs 450. Thereafter, the first and second components 322, 324 are fastened together thereby preventing the vanes 330 from disengaging from the hubs 450.

Figure 14:
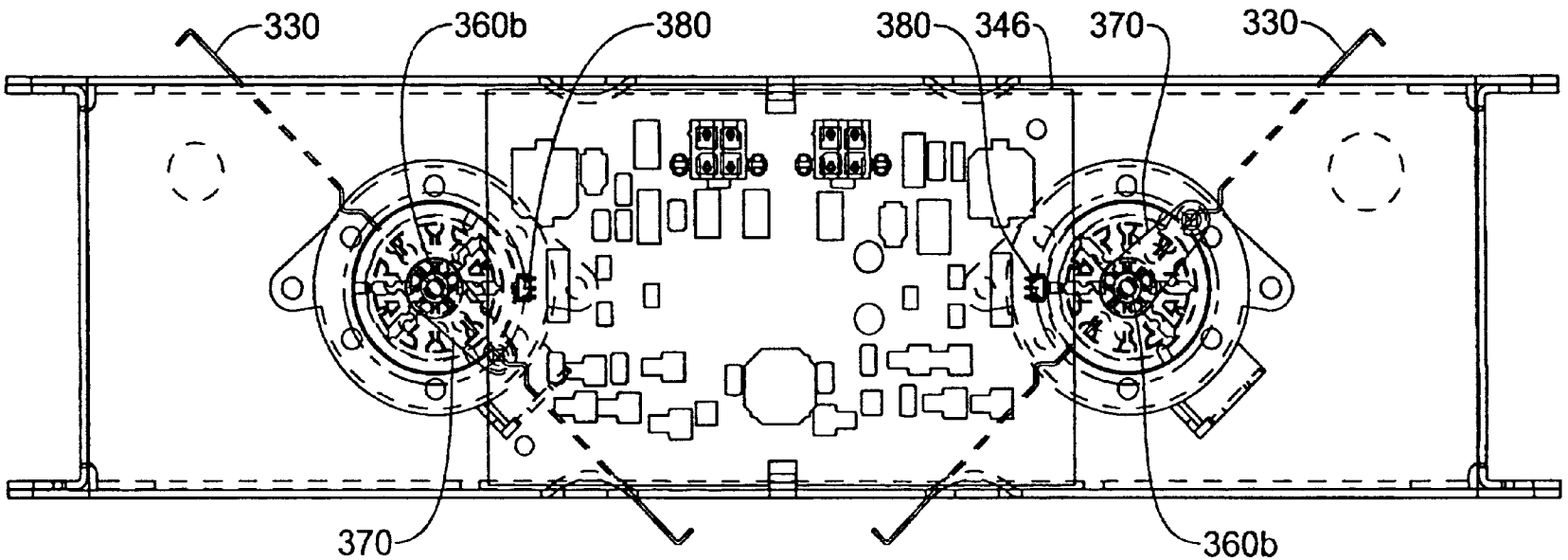
FIG. 14 is a right side view of the damper unit of FIG. 7 with the damper vanes shown in hidden-line.
Figure 15:
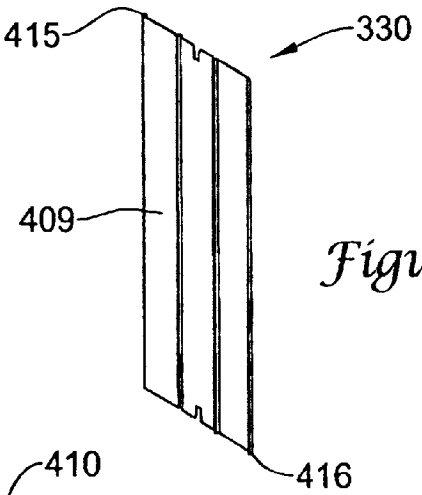
FIG. 15 is a perspective view of one of the damper vanes of the damper unit of FIG. 5.
Figure 18:
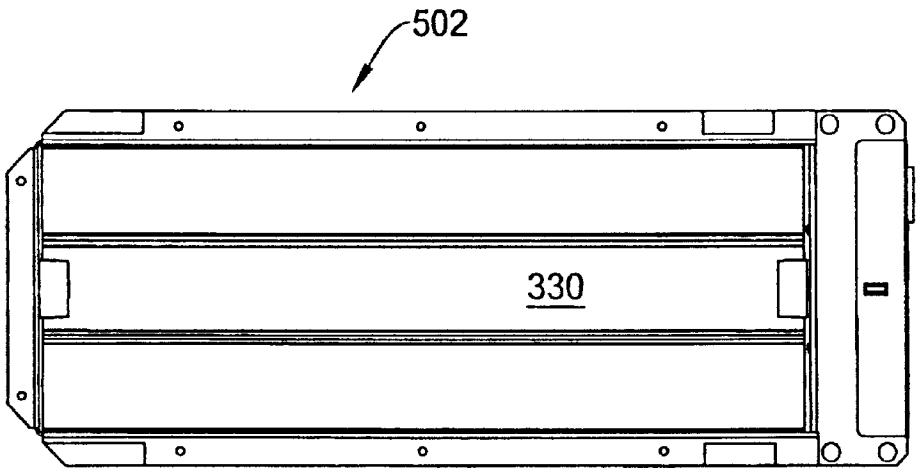
FIG. 18 is a plan view of an alternative damper unit in accordance with the principles of the present disclosure.

Referring now to FIGS. 15, 16A and 18, the drive shafts 360 of the drive motors 332 also include second ends 360*b* that project outwardly from the casings 359 into the housing 334. A rotational position indicator 370 (i.e., a flag) is mounted to the second end 360*b*. The indicators 370 project perpendicularly outwardly from the shafts 360 and rotate in concert with the shafts 360. As best shown in FIG. 14, portions of each of the motors 332 are positioned beneath the circuit board 346 (i.e., portions of the circuit board 346 cover or overlap the motors 332). With the circuit board 346 so positioned, the rotational position indicators 470 pass beneath the circuit board 346 with each revolution of their corresponding shafts 360. Sensing devices 380 are preferably positioned on the side of the circuit board 346 that faces the motors 332. The sensing devices 380 are adapted to detect each time the rotational position indicators 370 pass by the sensors. In one embodiment, the sensing devices 380 include Hall Effect sensors, and the rotational position indicators 370 include magnets capable of being sensed by the Hall Effect sensors. In other embodiments, the sensor can include an optical sensor, a proximity sensor, or any number of different types of sensors. As described in U.S. application Ser. No. 10/633,333, entitled "Self-Adjusting System for a Damper" and filed on a date concurrent herewith, the sensing devices 380 and indicators 370 provide data regarding the rotational positions of the vanes which is used by the control device to reset or calibrate the step counts of the motors. The above-identified application is hereby incorporated by reference in its entirety.

FIGS. 22–25 illustrate and alternative damper unit 502 that is equipped with only of the damper vanes 330. It will be appreciated that the damper unit 502 operates in a similar manner to the damper unit 302 previously described.

With regard to the forgoing description, changes may be made in detail, especially with regard to the shape, size, and arrangement of the parts. It is intended that the specification and depicted aspects be considered illustrative only and not limiting with respect to the broad underlying concepts of the present disclosure. Certain inventive aspects of the present disclosure are recited in the claims that follow.

What is claimed is:

1. A method for moving a vane of a damper between a first position and a second position, the method comprising:

providing a stepper motor, the stepper motor including a plurality of steps per one revolution of the stepper motor, directly coupling a shaft of the stepper motor to the vane;

causing the stepper motor to move a portion of the plurality of steps in a first direction to thereby move the vane from the first position to the second position; and causing the stepper motor to move a remaining portion of the plurality of step in the first direction to thereby move the vane from the second position back to the first position.

2. The method of claim 1, further comprising coupling a microcontroller to the stepper motor to control movement of the shaft of the motor.

* * * * *